US006136151A

United States Patent [19]

Davenport et al.

[11] Patent Number: 6,136,151

[45] Date of Patent: Oct. 24, 2000

[54] PRESS BELT AND PRESS ROLL COVER FOR PAPERMAKING

[75] Inventors: Francis L. Davenport, Ballston Lake, N.Y.; John R. Gray, Foxboro, Mass.

[73] Assignee: Albany International Corp., Albany, N.Y.

[21] Appl. No.: 09/216,347

[22] Filed: Dec. 18, 1998

[51] Int. Cl.[7] ..... D21F 2/00; D21F 3/00; B32B 5/06; B32B 5/26

[52] U.S. Cl. ..... 162/306; 162/358.4; 162/358.2; 162/901; 442/275

[58] Field of Search ..... 162/306, 358.4, 162/358.3, 358.2, 360.2, 360.3, 900, 901; 442/275

[56] References Cited

U.S. PATENT DOCUMENTS

| | | | |
|---|---|---|---|
| 412,656 | 10/1889 | O'Neill . | |
| 4,483,745 | 11/1984 | Wicks et al. . | |
| 4,552,620 | 11/1985 | Adams . | |
| 5,178,732 | 1/1993 | Steiner et al. | 162/360.2 |
| 5,298,124 | 3/1994 | Eklund et al. . | |

*Primary Examiner*—Stanley S. Silverman
*Assistant Examiner*—Dionne A. Walls
*Attorney, Agent, or Firm*—Pitney, Hardin, Kipp & Szuch, LLP

[57] ABSTRACT

In a papermaking machine for making paper and paperboard products, a press belt, press roll cover, or long nip shoe press belt, is disclosed that has both a permanent microscale roughness and areas of both hydrophilic and hydrophobic nature which properties promote good sheet smoothness and printability, while allowing for excellent sheet release.

9 Claims, 3 Drawing Sheets

PRESS BELT AND PRESS ROLL COVER FOR PAPERMAKING

BACKGROUND OF THE INVENTION

1. Field of the Invention

The present invention is directed towards a belt and roll cover for use in papermaking, more particularly, a belt and roll cover for use in the press section of a papermaking machine that improves the smoothness and printability of the sheet surface.

2. Description of the Prior Art

In the press section of a papermaking machine, the primary function of the fabrics that are used which come into contact with the paper web or sheet, normally known as press fabrics or felts, is to dewater the wet paper sheet efficiently and uniformly. At the same time it is important that, while providing this function, they do not mark the paper sheet. However, all press fabrics, because of the fibrous nature of the fabric surface, also impart its surface texture to some degree onto the paper sheet.

In presses that utilize two press fabrics going through the press nip with the paper sheet sandwiched between them, the sheet is dewatered from both sides, improving the efficiency of the press, provided of course there is enough mechanically applied load to press the water out of the paper sheet. Both sides of the sheet, however, will then, to some degree, have the fibrous surface of the press fabrics imparted into it, thereby rendering the sheet less than optimally smooth.

Another concern with press fabrics is a phenomena called sheet following. As fabrics age and change properties, one of the fabrics will tend to hold onto the sheet after it exits the press nip. If the situation deteriorates to a severe degree, the sheet will break from its continuous path out of the press nip, and follow one of the press fabrics around the press fabric path. This typically requires the press/machine to be shut down to remove the sheet, and any damaged components. This causes a loss in productivity and income.

In addition, typical press fabrics, because of their fibrous nature, also tend to "fill" as they age. That is, the papermaking furnish components become lodged within the surface of the press fabric. This can cause a change in dewatering properties and can lead to the aforesaid sheet following phenomena. Moreover, if the filling is non-uniform, or if the fabric surface becomes disturbed by the mechanical means employed (e.g. high-pressure water showers) to keep the surface free of contaminants, this can lead to another phenomena called sheet picking. Here, as the sheet comes into intimate contact with the press fabrics in the nip, the surface of the sheet is picked as the sheet/fabrics separate as they exit the nip. Small cellulose fibers, or portions thereof, or other organic or inorganic materials that make up the sheet are randomly and non-uniformly pulled/picked from the sheet surface every time the sheet/fabric is separated. This leads to further deterioration of the sheet surface from a quality, smoothness and printability standpoint. To correct for such sheet picking, additional paper processing steps, such as calendering, must be done to the sheet to enhance its surface properties, particularly smoothness.

In the situation of a press nip using one press fabric the sheet comes into contact with two very dissimilar surfaces, the press fabric and one of the press rolls. The press roll may include a roll cover which is very smooth and imparts a uniform surface to the paper sheet. A properly designed papermaking system will arrange the machine components (former, presses, dryer and calenders) to insure that the paper surfaces are equal for printing purposes. For some grades, such as linerboard, white top liner or folding carton board, the one smooth sheet side and one rougher side is actually a benefit from an end use standpoint.

Even with the presses with one fabric and one roll, there can, however, still be problems with sheet following and/or sheet picking. Press fabric designs may be utilized which minimize this problem. Press roll cover manufacturers have endeavored to develop release covers which are intended to minimize the tendency to pick the sheet surface. However, present day covers still need to be doctored to keep the surface clean from debris, and still pick at the sheet surface as it passes through the press nip.

The reason for this is that since the wet paper sheet tends to follow the smoothest or wettest surface out of the press nip, the sheet tends to follow the roll cover for some distance up its circumference as it exits the nip. The sheet is then pulled off the surface of the roll since the next downstream position (e.g. dryer section) is running at a higher speed. The sheet is literally pulled off from the roll cover. As speeds increase, the forces required to do this become substantial.

In U.S. Pat. No. 412,656, there is suggested the use of a rubber belt in a simple paper machine. The surface of the proposed belt differs little from roll covers used then and up to the present in that they still result in sheet picking and less than optimum sheet release.

In U.S. Pat. No. 4,552,620, there is taught a belt that functions both as a sheet contact cover and shoe press belt with a very specific chemistry and surface texture. It, however, has "stone like" texture which is similar to that of granite press rolls. Granite press rolls require doctoring as they cause picking. They also require substantial force to release the sheet from the surface due to the water film between the sheet and roll, which is why the sheet adheres so well to the roll surface.

U.S. Pat. No. 4,483,745 teaches a press apparatus that utilizes what is typically known as a transfer belt. Here the belt is in contact with one surface of the paper web through the nip and beyond. The belt supports the sheet (no open draw) and transports it from one station to another. The belt is impermeable and relatively smooth and hard, so that the paper sheet may follow the belt upon leaving the press nip without being rewet by a press fabric or other permeable belt. This arrangement is based upon the fact that the paper sheet will follow the surface to which it may be most strongly bonded by a thin, continuous water film. However, no structure of the belt is set forth itself beyond describing it as having a smooth upper surface with a smoothness and a hardness or density generally similar to a plain press roll cover. What is not addressed is the difficulty which would be encountered in attempting to remove a wet paper sheet from the surface of such a belt in a papermachine.

U.S. Pat. No. 5,298,124 teaches a transfer belt that allows the sheet to be transported from one station to another without rewetting the sheet. The belt has a supporting base with a particle-filled polymer coating. The belt is pressure responsive and is made relatively smooth in the press nip allowing a thin film of water to form between the belt and the sheet. Upon leaving the press nip, it returns to its uncompressed form to break the water film to allow the sheet to be transferred to the next sheet conveying belt.

While this belt has performed well as regards its transfer properties, and does not mark the sheet, the belt is pressure responsive. That is, there is some time required after the belt/paper web leaves the press nip before the water film breaks up, allowing the sheet to be released to the next position.

SUMMARY OF THE INVENTION

Accordingly, it is a principal object of the invention to provide for a press belt which allows for improved sheet smoothness and printability.

It is a further object of the invention to provide for a press belt which not only improves sheet quality but also avoids sheet following and sheet picking and reduces the need for downstream calendering.

It is a further object of the invention to provide a press roll cover with improved sheet release properties.

It is also a further object of the invention to provide a long nip shoe press belt which also functions with excellent sheet release.

A feature of the present invention is providing a belt with some components similar to that of the transfer belt as set forth in U.S. Pat. No. 5,298,124, the disclosure of which is incorporated herein by reference, for use as a press belt, or a roll cover for a press roll. The belt can also be used as a belt for an extended nip shoe press, as suggested by U.S. Pat. No. 4,552,620, the disclosure of which is incorporated herein by reference. In this regard, such a press belt, so configured, improves the printability of the sheet being formed and avoids the disadvantages of typical press fabrics and belts as aforenoted. Due to the nature of the belt surface which has a fine microscale roughness at all times, whether compressed in the press nip or uncompressed outside the press nip, allows for providing a smooth sheet, no sheet following or picking, and relatively easy and timely sheet release. These advantages may be realized through the use of such a belt as a long loop press belt, as a roll cover for a press roll, or as a belt for an extended nip shoe press.

BRIEF DESCRIPTION OF THE DRAWINGS

Thus by the present invention its objects and advantages will be realized the description of which should be taken in conjunction with the drawings wherein.

DETAILED DESCRIPTION OF THE PREFERRED EMBODIMENT

Figure 1:
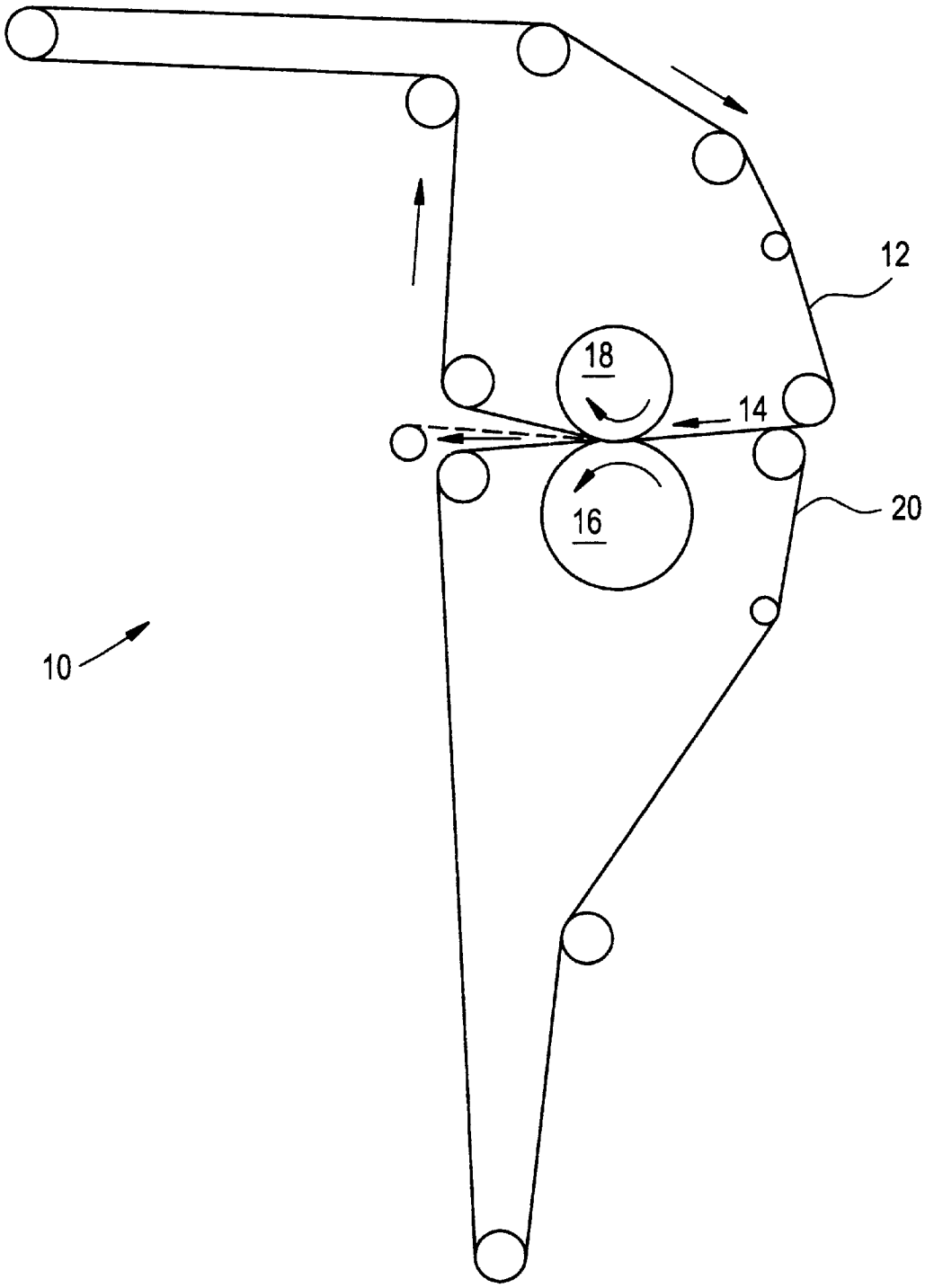
FIG. 1 is a somewhat schematic representative view of a press arrangement including a press belt providing for improved sheet smoothness and printability, incorporating the teachings of the present invention.

Turning now more particularly to the drawings, FIG. 1 shows a representative press portion 10 of a papermaking machine. A press belt 12 is shown passing between the nip 14 formed between a first press roll 16 and second press roll 18. In the illustration, which is a double felted press, a press fabric 20 is shown on the lower portion thereof with the press belt 12 replacing the top press fabric normally used. This, of course, can be reversed as long as the press belt is placed on the side in contact with the sheet surface where smoothness and printability is required. Also, while a double felted press is shown, it should be understood that, in a conventional single-felted press (roll or shoe) a press belt run could be added so it again results in a configuration like FIG. 1. Also the press roll cover can be replaced by the press belt instead of having an independent belt run. Where a loss in dewatering can be tolerated, it should be understood that, in a conventional single felt press (roll or shoe) the press fabric can be replaced by the press belt again, however, with the sheet being in contact with the press belt on the side where smoothness and printability is desired.

Figure 2:
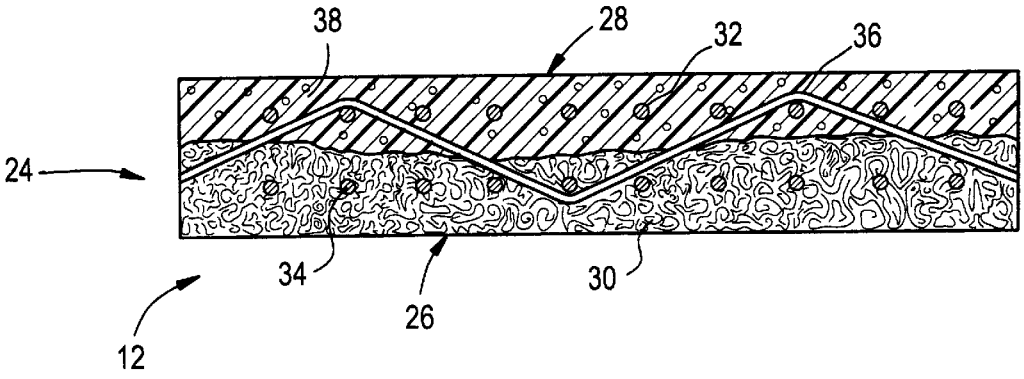
FIG. 2 is a cross sectional view, taken in the cross machine of a belt used as a press belt or press roll cover.

Turning now to FIG. 2, there is shown a cross section of the press belt 12 having the desired properties and characteristics. The belt as disclosed and described in detail in U.S. Pat. No. 5,298,124 has some of the characteristics of the press belt of this invention. Briefly, the base 24 may take a variety of forms, woven or non-woven having a back side 26 and paper side 28. It may include a fibrous web 30 with a textile material attached to the back side 26 instead of or in addition to web 30. Top weft yarns 32 and bottom weft yarns 34 are shown along with warp yarns 36 and coating 38 on the paper side 28.

It is important to note, however, that the present invention is impervious to water, air, or oil. As a press belt or long nip shoe press belt, the base support again can be any commonly used structure available to one skilled in the art. While preferred endless, the belt in either case can be on machine seamable. As a press roll cover, different reinforcement structures could be used as required to give the roll cover adequate structural integrity.

An important difference between this invention and that taught in U.S. Pat. No. 5,298,124 is that with the inventive belt or roll cover, the surface microroughness and both hydrophilic/hydrophobic areas always exist, regardless of press nip pressure, to prevent formation of a continuous water film at the interface between the paper web and belt roll cover surface. This surface facilitates virtually instantaneous sheet release. This microroughness, compared to conventional press fabrics, avoids transferring texture to the sheet surface when compressed in the nip. Also press loading can be increased since no further surface marking should be encountered, further improving sheet dewatering (by the press fabric in the nip), allowing for a speed increase. Downstream calendering may be reduced, allowing sheet bulk (related to folding stiffness) to be maintained with improved smoothness. Doctoring or conditioning/cleaning of the press belt can be minimized or even eliminated.

It has been found that modifying the formulation and/or structure of the belt results in the continuous presence of the required microsmoothness.

Belts with 0%, 20%, and 30% clay filler were made. The clay is considered to be hydrophilic compared to a resin material. It's well known that higher surface energy is desirable to allow the sheet to follow the belt surface. Low surface energy is desirable to allow sheet release.

It is also known that microscale roughness is desirable to prevent a continuous water film to form. A continuous water film promotes good sheet adhesion to the belt. However, for a press belt of the invention, this is undesirable.

In this regard, a simple immersion test was developed to determine water release. A high marking means the least water is retained on the belt surface, promoting good sheet release.

As seen in Table I, these properties are summarized (a relative ranking method was used.)

TABLE I

| % Filler | Micro-Roughness | Surface Energy | Water Immersion |
|---|---|---|---|
| 0 | 2 | 3 | 1 |
| 20 | 1 | 1 | 2 |
| 35 | 2 | 2 | 3 |

1 = High
2 = Medium
3 = Low

The belt with 20% filler performed extremely well with respect to sheet release. In spite of having a higher measured surface energy, the sheet release properties can be explained by the good microroughness and the hydrophilic/hydrophobic character of random sites on the belt.

The belt with 0% filler would not release the sheet even though it was hydrophobic in nature. It was too smooth and would not assist in breaking up the water film between the belt surface and paper sheet. The belt with 35% filler released the sheet some distance after the press nip. It behaved similar to a belt made in accordance with that taught in U.S. Pat. No. 5,298,124. Bear in mind the latter belt's "roughness" is really only present after a period of time as the fabric recovers outside the press nip. In this regard, please see FIG. 6 of said patent which is a Scanning Electron Microscope of the cross section of a belt taught therein.

A belt with the properties above was tested on an experimental pilot machine. The purpose of the exercise was to evaluate sheet release compared to the best normal commercial "release roll" cover. The evaluation was both visual (geometry of the sheet as it released from the belt or roll cover) and by the quantity of "crumbs" collected by a surface doctor. Crumbs are paper fibers/fillers pulled from the sheet by the contact surface of a belt or roll cover. It is a primary function of a doctor to remove these materials from the belt/cover surface before recontacting the sheet in the press nip.

The press section had a double felted first press, and single felted second press. The roll cover and belt were consecutively run in the "top" position. A very sticky newsprint furnish was used as it was the "worst case test" for roll cover release.

The release cover performed adequately with the sheet riding on the cover up until approximately the 8 o'clock position. Substantial amounts of wet crumbs were collected at the roll surface doctor.

The press belt was then tested in a configuration similar to FIG. 1. The belt performed very well. The sheet released very cleanly with little draw, at least as good as the roll cover. For the duration of the test however, there was no apparent build up of material on the belt surface. There were absolutely no crumbs or fibers seen at the belt surface doctor.

Figure 3:
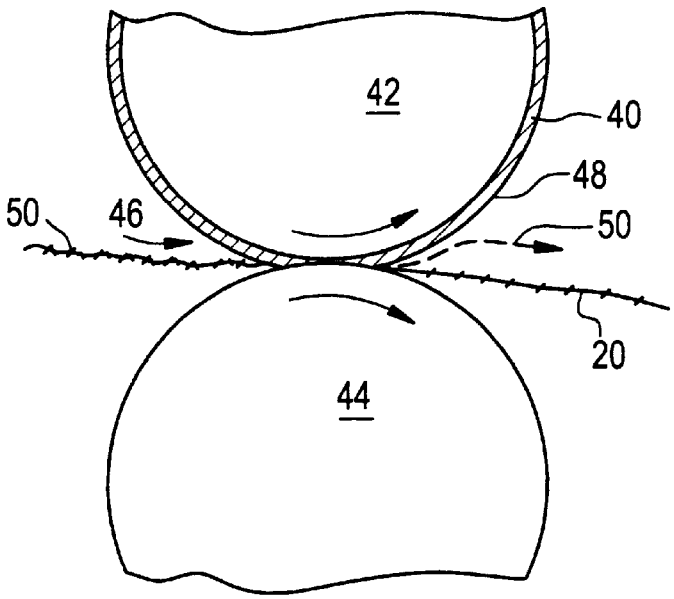
FIG. 3 is a cross sectional view of the use of a press roll cover on a press roll, incorporating the teachings of the present invention.

In addition, the belt described can be used as a press roll cover 40 as shown in FIG. 3. In this regard, the press roll cover 40, having the characteristics of the press belt 12 is provided on a press roll 42 which, with press roll 44, creates a nip 46. The paper side surface 48 (which corresponds to surface 28 of press belt 12) engages the paper sheet 50 on press fabric 20 which passes through nip 46 which may thereafter be picked off for further processing. Note, the sheet 50 may travel a very short distance on the press cover surface 48 prior to being picked off therefrom. Such arrangement provides for the advantages noted as to the use of the press belt 12.

Figure 4:
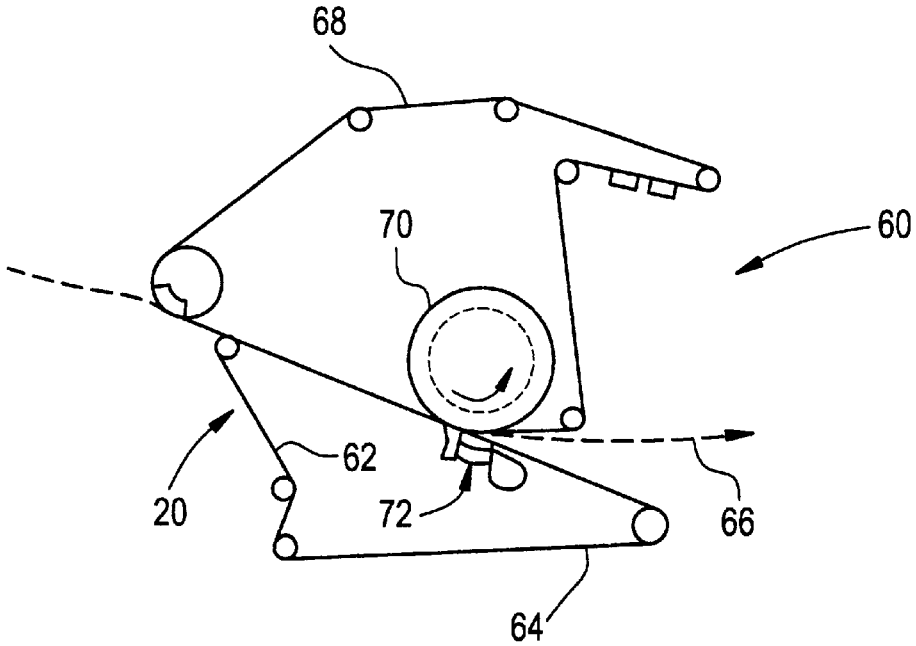
FIG. 4 is a cross sectional view of the belt used as long nip shoe press belt, incorporating the teachings of the present invention.

In FIG. 4, there is shown a long nip press arrangement 60, with the press belt 20 illustrated as combined press belt/shoe press belt. In this case, the belt 20 will be coated on both sides and finished on the shoe side 62 to an acceptable smoothness. The sheet contacting side 64 will have the proper microroughness and surface chemistry to allow sheet release. In the drawing, the paper sheet 66 is shown along with press fabric 68, vented press roll 70 and shoe 72 to complete the illustration.

In addition, other potential advantages of a belt of this invention include the ease of the installation versus that of replacing a press roll, and eliminating the need for an expensive roll cover and spares.

As a press roll cover, sheet release is improved; breaks caused by too high a draw are minimized, and the roll surface runs cleaner, reducing the need for doctoring. This reduces roll cover surface and doctor blade wear, reducing operating costs.

Thus by the present invention its objects and advantages are realized and, although preferred embodiments have been disclosed and described in detail herein, its scope should not be limited thereby, rather its scope should be determined by that of the appended claims.

What is claimed is:

1. In a papermaking machine having a press section for making paper and paper board products, a press belt for creating a smooth and printable surface of a formed paper sheet, said press belt comprising:

an endless loop with a paper side surface, said paper side surface providing a contacting surface with the paper sheet on the side of the sheet in which smoothness and printability is desired, and said paper side surface having both a permanent microscale roughness and areas of both hydrophilic and hydrophobic properties regardless of nip pressure in order to prevent formation of a continuous water film at an interface between the paper sheet and the paper side surface.

2. The invention in accordance with claim 1 wherein said press belt is incorporated in a single fabric press.

3. The invention in accordance with claim 1 wherein said press belt is incorporated in a double fabric press.

4. The invention in accordance with claim 3 which includes a press fabric which engages the sheet on a side opposite to that of the press belt.

5. The invention in accordance with claim 1 wherein said press belt is a long nip press belt and is incorporated in a single fabric long nip press.

6. The invention in accordance with claim 5 which includes a press fabric which engages the sheet on a side opposite to that of the long nip press belt.

7. In a papermaking machine having a press section for making paper and paper products, a press roll cover for creating a smooth and printable surface of a formed paper sheet, said press roll cover comprising:

a paper side surface; said paper side surface providing a contacting surface with the paper sheet on the side of the sheet in which smoothness and printability is desired; and said paper side surface having both a permanent microscale roughness and areas of both hydrophilic and hydrophobic properties regardless of press nip pressure in order to prevent formation of a continuous water film at an interface between the paper sheet and the paper side surface.

8. The invention in accordance with claim 7 wherein said press roll cover is incorporated in a single fabric press.

9. The invention in accordance with claim 7 which includes a press fabric which engages the sheet on a side opposite to that of the press roll cover.

* * * * *